United States Patent [19]

Kunugi

[11] Patent Number: 4,476,694

[45] Date of Patent: Oct. 16, 1984

[54] ABSORPTION COOLING AND HEATING SYSTEM

[75] Inventor: Yoshifumi Kunugi, Ibaraki, Japan

[73] Assignee: Hitachi, Ltd., Tokyo, Japan

[21] Appl. No.: 459,662

[22] Filed: Jan. 20, 1983

[30] Foreign Application Priority Data

Jan. 22, 1982 [JP] Japan ..... 57-7578

[51] Int. Cl.[3] ..... F25B 15/00

[52] U.S. Cl. ..... 62/476; 62/497

[58] Field of Search ..... 62/148, 476, 486, 497

[56] References Cited

U.S. PATENT DOCUMENTS

| | | | |
|---|---|---|---|
| 2,217,303 | 10/1940 | Andersson | 62/148 X |
| 2,221,750 | 11/1940 | Ashby et al. | 62/148 X |
| 2,250,288 | 7/1941 | Ashby | 62/497 |
| 3,250,087 | 5/1966 | English | 62/476 X |
| 3,527,060 | 9/1970 | Kruggel | 62/476 X |
| 3,641,784 | 2/1972 | Schlichtig | 62/476 |

*Primary Examiner*—Lloyd L. King

*Attorney, Agent, or Firm*—Antonelli, Terry & Wands

[57] ABSTRACT

An absorption cooling and heating system including a generator, a condenser, a subcooler, an evaporator, an absorber and an absorption heat exchanger, wherein the generator includes a container of a shape in which the liquid level of a solution contained therein has, in a vertical cross section, a horizontal length greater than the maximum depth of the solution and which has a heating source at one end thereof and an inlet port of a rich solution opening at the other end thereof. The generator includes a poor solution passage mounted in the container which extends through the solution in the container and opens at the one end of the generator to allow take-out of the poor solution to be achieved.

10 Claims, 3 Drawing Figures

ABSORPTION COOLING AND HEATING SYSTEM

BACKGROUND OF THE INVENTION

This invention relates to an absorption cooling and heating system.

In known absorption heating and cooling systems, ammonia and flurocarbon are used as refrigerants, and water and tetraethyleneglycol.dimethylether are used as absorbent. In a system using ammonia as a refrigerant and water as an absorbent, a number of problems arise.

More particularly, with ammonia serving as a refrigerant and water serving as an absorbent the boiling points are close to each other, so that the refrigerant gas (ammonia gas) generated in the generator contains a considerably high proportion of absorbent (water), making it necessary to effect rectification to raise the purity of the refrigerant gas.

Moreover, the provision of the generator with a rectifying function renders the internal construction of the generator very complex. In addition to the generator being complex in construction, shelves and other parts require a high degree of inishes, thereby increasing the overall cost.

Additionally, a portion of the heat of absorption can be used for heating the rich solution, but the refrigeration cycle has a low efficiency if no heat of absorption is used for heating the rich solution.

A system of using dichlorodifluoromethane as a refrigerant and tetraethyleneglycol.dimethylether as an absorbent also has a number of problems.

More particularly, to heat the refrigerant gas produced in the generator until it is released from the generator is a waste of energy.

Additionally the amount of heat exchanged in the solution heat exchanger is great, requiring an increase in the size of the heat exchanger. Thus, the system is disadvantageous from the points of view of cost and dimensions.

Moreover, poor solution has a high degree of subcooling when it is joined to the refrigerant gas, so that the progress of absorption within the absorption heat exchanger is adversely affected thereby reducing the efficiency of the refrigeration cycle.

Furthermore, the refrigerant gas released from the generator is in the state of superheating and, if the refrigerant gas in this state is fed to the condenser for cooling, the cooling requirement in the condenser or the amount of heat released to outside would be excessively great thereby also reducing the efficiency of the refrigeration cycle.

SUMMARY OF THE INVENTION

An object of this invention is to provide an absorption cooling and heating system requiring no solution heat exchanger.

Another object is to provide an absorption cooling and heating system capable of operating with a high degree of efficiency by recovering the sensible heat of the refrigerant in a gaseous state.

Still another object is to provide an absorption cooling and heating system using a refrigerant comprising monochlorodifluoromethane (fluorocarbon) capable of doing without heat exchange with a solution.

Still another object is to provide an absorption cooling and heating system provided with a generator of simple construction.

A further object is to provide an absorption cooling and heating system provided with a generator capable of reducing its heating requirement with respect to the amount of generated gas.

To accomplish the aforesaid objects, the invention provides, in an absorption cooling and heating system comprising a generator, a condenser, a subcooler, an evaporator, an absorber and an absorption heat exchanger operatively connected with one another, with the generator being shaped and configured in such a manner that, in a vertical cross section, the horizontal length of the liquid level of the solution contained in the interior is greater than the depth of the solution. The equipment serving as the generator has a heating source at one end thereof and is formed with an inlet port for a rich solution at the other end thereof, with an outlet passage for withdrawing a poor solution from the generator opens at one end thereof within the generator and extends through the solution in the generator.

The term "solution" as used herein refers to a refrigerant and an absorbent in a mixed condition. The terms "rich solution" and "poor solution", as used herein, respectively refer to a solution in a condition in which a large amount of refrigerant is contained in the solution, and a solution in a condition in which a small amount of refrigerant is contained in the solution.

DETAILED DESCRIPTION OF THE PREFERRED EMBODIMENTS

Figure 1:
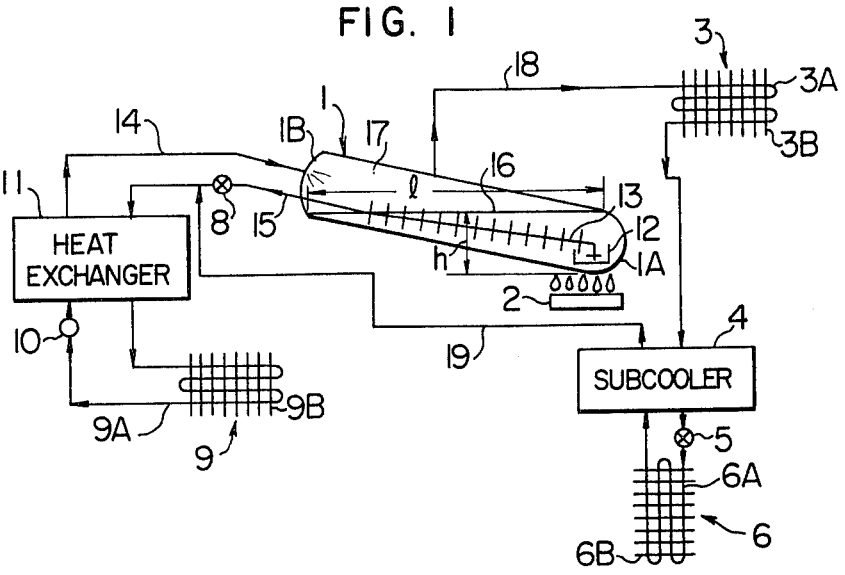
FIG. 1 is a partially schematic view of an absorption cooling and heating system comprising one embodiment of the invention.

Referring now to the drawings wherein like reference numerals are used throughout the various views to designate like parts and, more particularly, to FIG. 1, according to this figure, an absorption cooling and heating system, using monochlorodifluoromethane (fluorocarbon) as a refrigerant and tetraethyleneglycol. dimethylether as an absorbent fluid, includes a generator generally designated by the reference numeral 1, heated by a heating source 2 to produce a refrigerant in a gaseous state; a condenser generally designated by the reference numeral 3 for condensing the refrigerant in a gaseous state produced in the generator 1 by cooling refrigerant; expansion means 5 for reducing the pressure of the refrigerant in a liquid state obtained by condensation; an evaporator generally designated by the reference numeral 6 evaporating the refrigerant, in a liquid state having a gaseous refrigerant partly mix therein, that has its pressure reduced to cool a fluid in the vicinity thereof by depriving the fluid of a latent heat of evaporation; a subcooler 4 causing heat exchange to take place between the refrigerant flowing into the evaporator 6 and the refrigerant released from the evaporator 6 to bring the refrigerant in a liquid state flowing into the evaporator 6 to a subcooled condition; an absorber generally designated by the reference numeral 9 having the refrigerant released from the subcooler 4 and a poor solution (a solution, containing a small amount of refrigerant, produced in the generator 1 introduced therein after they are joined to cause the refrigerant to be absorbed in the poor solution while cooling refrigerant to thereby generate a rich solution, containing a large amount of refrigerant; a pump 10 for pumping the rich solution produced in the absorber 9; a heat exchanger 11 allowing heat exchange to take place between the solution immediately before flowing into the absorber 9 and the rich solution immediately after being released from the pump 10; and a pressure reducer 8 for reducing the pressure of the poor solution led from the generator 1 located in a position immediately before the poor solution joins the refrigerant gas led from the subcooler 4.

The generator 1 is of elongated cylindrical shape and is arranged to be slightly tilting with respect to the horizontal so that the liquid level of the solution constituting a generating surface of the refrigerant has a horizontal length l which is greater than a maximum depth h of the solution. Thus, the generator 1 has a large generating surface for the refrigerant. An end portion 1A of the generator 1, located in a lower position, has a cup 12 located therein, and the burner 2, serving as a heating source, is located outside the generator 1. A poor solution tube 13, for introducing the poor solution stripped in the generator 1 into the absorber 9, has a take-out port opening in the cup 12 and extends through the poor solution in the generator 1. A rich solution line 14 for pumping a rich solution produced in the absorber 9 to the generator 1 through the heat exchanger 11 by the pump 10 opens in an end portion 1B of the generator 1 located in a higher position.

The condenser 3 includes a refrigerant tube 3A, heat transfer fins 3B attached to the refrigerant tube 3A and a fan, not shown, flowing air. The fan is operative to cool the refrigerant flowing through the heat transfer tube 3A.

The evaporator 6, usually mounted inside a space to be cooled, includes a refrigerant tube 6A, heat transfer fins 6B attached to the refrigerant tube 6A, and a fan, not shown, for circulating air through the evaporator 6.

The absorber 9 includes a tube 9A, heat transfer fins 9B attached to the tube 9A, and a fan, not shown, for circulating air.

The embodiment of FIG. 1 operates in the following manner. The end portion 1A of the generator 1 has a bottom thereof heated by the burner 2, so that the solution is changed to a poor solution by releasing the refrigerant in a gaseous state therefrom. The poor solution, having high temperature, flows from the cup 12 through the poor solution tube 13 and gives off heat to the rich solution to become subcooled, before being released into the poor solution line 15 connected to the poor solution tube 13 at the end portion 1B in the higher position.

The rich solution, containing a large amount of refrigerant, is introduced from the rich solution line 14 into the end portion 1B of the generator 1 while its temperature is near the boiling point. The rich solution generates a refrigerant gas by being heated by a heat given off by the poor solution flowing through the poor solution tube 13 while the rich solution itself flows toward the heating section of the generator 1 by having the concentration of the refrigerant decrease. The solution within the generator 1 has a liquid level 16, so that the refrigerant gas generated is collected in a gas space 17, to flow therefrom through a refrigerant line 18 to the condenser 3.

If the internal pressure of the generator 1 is 16.8 $kg/cm^2$ when the concentration of the rich solution is 42.4%, then the rich solution is heated up to about 86° C. as it enters the generator 1. As soon as the rich solution enters the generator 1, it begins to boil. The solution in the heating section 1A of the generator 1 having a temperature of 150° C., the poor solution has a concentration of 18.7%. The amount of the refrigerant gas generated when the rich solution of 86° C. becomes a poor solution of 150° C. has a ratio of 43.2%, where the temperature is between 86° and 100° C., a ratio of 32.8%, where the temperature is between 100° and 120° C., a ratio of 18.2%, where the temperature is between 120° and 140° C. and a ratio of 5.8%, where the temperature is between 140° and 150° C., with the majority of the refrigerant gas being generated on the lower temperature side of the generator 1. Thus, the refrigerant gas released from the generator 1 through the refrigerant line 18 has a temperature of about 107° C. which is lower by about 43° C. than the temperature of the refrigerant in absorption cooling and heating systems of the prior art.

The refrigerant changed to a liquid stated by condensation at the condenser 3 reduces its pressure at the pressure reducer 5 after being subcooled at the subcooler 4, before being evaporated in the evaporator 6 into a gaseous state. At this time, the air in the room is cooled by the latent heat of evaporation. The refrigerant in a gaseous state obtained by evaporation is brought to a superheated condition in the subcooler 4, before flowing through a refrigerant line 19 and joining the poor solution flowing through the poor solution line 15.

Meanwhile the poor solution flowing through the poor solution tube 13 that has been subcooled as a result of heating the solution in the generator 1 is released from the generator 1 at 91° C. and flows through the poor solution line 15 to the pressure reducer 8 to have its pressure reduced, before joining the refrigerant gas of low pressure of 38° C. flowing through the refrigerant line 19 from the evaporator 6. This stream of two phase has an equilibrium temperature which drops to a level as low as 86° C. However, there are high temperature portions and low temperature portions locally in the stream, so that the stream is subjected to heat exchange with a rich solution in the heat exchanger 11 to absorb the refrigerant and heat the rich solution. The two phase stream released from the heat exchanger 11 has a temperature of 56° C. which continues absorption in the absorber 9 before changing to a rich solution. At this time, the heat of absorption is released to outside by a fan. The rich solution released from the absorber 9 has its pressure raised by the pump 10 at 43° C. and has its temperature raised to 86° C. by obtaining the heat of absorption in the heat exchanger 11, before being led to the generator 1 through the rich solution line 14.

Figure 2:
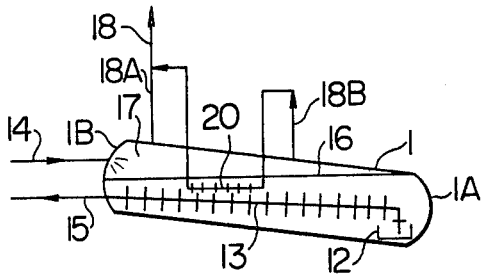
FIG. 2 is a schematic view of portions of the absorption cooling and heating system in accordance with another embodiment of the present invention.

As shown in FIG. 2, the refrigerant gas has two outlet ports in the generator 1 or a refrigerant line 18A of a lower temperature side and a refrigerant line 18B of a higher temperature side, with the refrigerant line 18B being connected to a heat transfer tube 20 for heating the solution. The lines 18A and 18B are thereafter joined into the refrigerant line 18. This arrangement is conducive to increased efficiency obtained in effecting cooling and heating.

Figure 3:
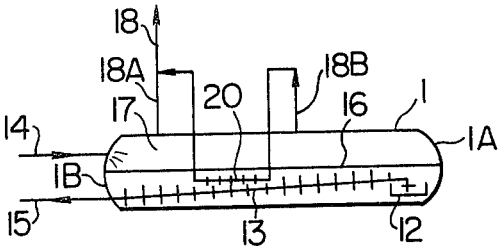
FIG. 3 is a schematic view of portions of the absorption cooling and heating system in accordance with still another embodiment of the present invention.

In FIG. 3, the generator 1 is located substantially horizontally; however, it is to be noted that the generator 1 in FIG. 1 may also be arranged horizontally.

By reducing as much as possible the temperature of the refrigerant gas introduced into the condenser 3 and the temperature of the stream of two phase introduced into the absorber 9, it is possible to greatly increase efficiency. The temperature of the refrigerant in the refrigerant line 18 shown in FIGS. 2 and 3 is 90° C. To reduce the temperature of the two phase stream entering the absorber 9, it is essential that the hot end temperature differential in the heat exchanger 11 be minimized. To this end, it is necessary to subject the poor solution to subcooling within the generator 1, so as to reduce the equilibrium temperature as the poor solution having its pressure reduced by the pressure reducer 8 is mixed with the refrigerant gas of low pressure. Thus, the solution heat exchanger can be eliminated.

The above-described embodiments of the absorption cooling and heating system in conformity with the invention can achieve a number of advantageous effects.

More particularly, a refrigerant in a gaseous state generated in the generator can be quickly separated from the solution and used for heating the solution. Thus the heating requirement of the generator decreases and the amount of heat released from the condenser can be reduced. This improves the efficiency of the cooling and heating system and makes it possible to obtain a compact size in a condenser.

Additionally, absorption of the refrigerant is promoted as much as possible within the absorption heat exchanger for heating the rich solution by the heat of absorption. This reduces the heating requirement of the generator and the heat released from the absorber thereby improving the efficiency of the cooling and heating system and making it possible to obtain a compact size in an absorber.

Furthermore, the solution within the generator is heated by the poor solution produced in the high temperature section of the generator, thereby eliminating the solution heat exchanger.

Also the refrigerant in a gaseous state is only generated in the generator to thereby prevent overheating of the refrigerant gas thereby further promoting the reduction of the heating requirement of the generator and reducing the amount of heat released from the condenser.

In the present invention, the poor solution released from the generator is mixed, after having its pressure reduced, with a refrigerant gas of low temperature to obtain a drop in temperature thereby further promoting the reduction of the heating requirement of the generator and the reduction in the amount of heat released from the absorber.

In summary, by performing a cooling operation with the cooling and heating system according to the invention by setting temperatures in the generator, condenser, evaporator and absorber at 150° C., 43° C., 10° C. and 48° C. respectively and with temperatures of 5° C. for both superheating and subcooling, it is possible to obtain a coefficient of performance of 0.83.

What is claimed is:

1. An absorption cooling and heating system comprising:

generating means including a heating source means for heating a solution to cause a refrigerant contained in the solution to evaporate into a refrigerant in a gaseous state and at the same time produce a poor solution of low refrigerant content, a container of a shape in which a liquid level of a solution contained therein has a horizontal length greater than a maximum depth of said solution, a poor solution passage provided in an interior of said container and extending through the solution, said poor solution passage having a poor solution take-out port opening at one end of said container, a rich solution introducing section opening at the other end of said container for introducing a rich solution of high refrigerant content into said container, and a refrigerant gas take-out port for the refrigerant in a gaseous state obtained by generation from the solution;

a condenser connected to said refrigerant gas take-out port of said generating means;

pressure reducing means connected to said condenser;

an evaporator connected to said pressure reducing means;

an absorber connected to said evaporator and said poor soultion passage in said generating means;

pump means located between an outlet end of said absorber and the rich solution introducing section of said generating means;

a subcooler causing heat exchange to take place between the refrigerant flowing into said evaporator and the refrigerant flowing out the evaporator; and a heat exchanger means for causing a heat exchange to take place between the solution flowing into said absorber and the solution flowing out of said absorber.

2. An absorption cooling and heating system as claimed in claim 1 wherein said container of said generating means is of elongated cylindrical shape and arranged so as to be slightly tilting with respect to the horizontal.

3. An absorption cooling and heating system as claimed in claim 2, wherein said heating source means is located in a portion of said container of said generating means which is at the lower end thereof.

4. An absorption cooling and heating system as claimed in claim 2, wherein a cup is mounted in said container of said generating means in the portion thereof which is at the lower end thereof, said poor solution take-out port of said poor solution passage opening into said cup.

5. An absorption cooling and heating system as claimed in claim 1, wherein said container of said generating means is of elongated cylindrical shape and arranged so as to be substantially horizontal.

6. An absorption cooling and heating system as claimed in claim 5, wherein said heating source is located in a portion of said container of said generating means which is at the one end thereof, and a cup is mounted in said container in the portion of said container which is at the one end thereof.

7. An absorption cooling and heating system as claimed in claim 6, wherein said poor solution take-out port of said poor solution passage opens into said cup.

8. An absorption cooling and heating system as claimed in claim 2, wherein said container of said generating means is provided with a plurality of refrigerant gas take-out ports including a first take-out port and a second take-out port, said second take-out port releasing a refrigerant gas flowing through a heat transfer passage extending through the solution in said container of said generating means before joining a refrigerant gas flowing from said first take-out port toward said condenser.

9. An absorption cooling and heating system as claimed in claim 5, wherein said container of said generating means is provided with a plurality of refrigerant gas take-out ports including a first take-out port and a second take-out port, said second take-out port releasing a refrigerant gas flowing through a heat transfer passage extending through the solution in said container of said generating means before joining a refrigerant gas flowing from said first take-out port toward said condenser.

10. An absorption cooling and heating system as claimed in claim 2, wherein said solution is a mixture of a refrigerant and an absorbent, and the refrigerant comprises a refrigerant of a Freon system while the absorbent comprises tetraethyleneglycol.dimethylether.

* * * * *